US011477555B2

(12) United States Patent
Kuntzman et al.

(10) Patent No.: US 11,477,555 B2
(45) Date of Patent: Oct. 18, 2022

(54) ACOUSTIC TRANSDUCERS HAVING NON-CIRCULAR PERIMETRAL RELEASE HOLES

(71) Applicant: Knowles Electronics, LLC, Itasca, IL (US)

(72) Inventors: Michael Kuntzman, Chicago, IL (US); Sung B. Lee, Chicago, IL (US); Vahid Naderyan, Chicago, IL (US); Yunfei Ma, Buffalo Grove, IL (US); Bing Yu, Elk Grove Village, IL (US)

(73) Assignee: Knowles Electronics, LLC, Itasca, IL (US)

( * ) Notice: Subject to any disclaimer, the term of this patent is extended or adjusted under 35 U.S.C. 154(b) by 51 days.

(21) Appl. No.: 17/081,628

(22) Filed: Oct. 27, 2020

(65) Prior Publication Data

US 2021/0136475 A1 May 6, 2021

Related U.S. Application Data

(60) Provisional application No. 62/931,316, filed on Nov. 6, 2019.

(51) Int. Cl.
*H04R 1/08* (2006.01)

(52) U.S. Cl.
CPC ..... *H04R 1/08* (2013.01); *H04R 2201/003* (2013.01)

(58) Field of Classification Search
CPC ..... H04R 1/08; H04R 2201/003; H04R 1/04; H04R 31/003; H04R 19/005; H04R 7/18;
(Continued)

(56) References Cited

U.S. PATENT DOCUMENTS 6,847,090 B2 1/2005 Loeppert
8,934,649 B1 1/2015 Lee et al.
(Continued)

FOREIGN PATENT DOCUMENTS

DE 102006002106 A1 7/2007
DE 102014212340 A1 1/2015
(Continued)

OTHER PUBLICATIONS

Loeppert, U.S. Appl. No. 16/923,068, U.S. Patent and Trademark Office, filed Jul. 7, 2020.
(Continued)

*Primary Examiner* — Tuan D Nguyen
(74) *Attorney, Agent, or Firm* — Loppnow & Chapa; Matthew C. Loppnow

(57) ABSTRACT

An acoustic transducer comprises a transducer substrate having an aperture defined therethrough. At least one diaphragm is disposed on the transducer substrate over the aperture. A back plate is disposed on the transducer substrate and axially spaced apart from the at least one diaphragm. A perimetral support structure is disposed circumferentially between the at least one diaphragm and the back plate at a radially outer perimeter of the back plate. A plurality of perimetral release holes are defined circumferentially through at least one of the at least one diaphragm or the back plate proximate to and radially inwards of the perimetral support structure, at least a portion of the plurality of perimetral release holes defining a non-circular shape.

20 Claims, 8 Drawing Sheets

(58) Field of Classification Search
CPC .... H04R 19/04; H04R 31/00; H04R 2201/02; H04R 2231/00; H04R 1/083
See application file for complete search history.

(56) References Cited

U.S. PATENT DOCUMENTS

| | | | | |
|---|---|---|---|---|
| 9,743,191 | B2 | 8/2017 | Pal | |
| 10,315,912 | B2 | 6/2019 | Nawaz | |
| 2015/0358735 | A1* | 12/2015 | Klein | H04R 19/005 257/419 |
| 2020/0109048 | A1 | 4/2020 | Lee | |
| 2020/0186940 | A1* | 6/2020 | Sun | H04R 19/005 |
| 2020/0245077 | A1 | 7/2020 | Loeppert | |

FOREIGN PATENT DOCUMENTS

| | | | |
|---|---|---|---|
| DE | 112012007235 | T5 | 9/2015 |
| DE | 10215122781 | A1 | 6/2016 |
| EP | 2565153 | B1 | 11/2015 |
| WO | 2020112769 | | 6/2020 |
| WO | 2020139860 | | 7/2020 |

OTHER PUBLICATIONS

Johnson, U.S. Appl. No. 16/894,608, U.S. Patent and Trademark Office, filed Jun. 5, 2020.
Kuntzman, U.S. Appl. No. 17/081,628 U.S. Patent and Trademark Office, filed Oct. 27, 2020.
Loeppert, U.S. Appl. No. 16/887,822 U.S. Patent and Trademark Office, filed May 29, 2020.
Loeppert, U.S. Appl. No. 63/016,135 U.S. Patent and Trademark Office, filed Apr. 27, 2020.
Griesinger, Cited References, Official Communication from Deutsches Patent—und Markenamt, Aug. 18, 2021, München, Germany.

* cited by examiner

ACOUSTIC TRANSDUCERS HAVING NON-CIRCULAR PERIMETRAL RELEASE HOLES

CROSS-REFERENCE TO RELATED APPLICATIONS

The present application claims the priority benefit of U.S. Provisional Application No. 62/931,316, filed Nov. 6, 2019, which is incorporated herein by reference.

TECHNICAL FIELD

The present disclosure relates generally to acoustic transducers for microphone assemblies having non-circular perimetral release holes for providing a smoother etch front.

BACKGROUND

Microphone assemblies are used in electronic devices to convert acoustic energy to electrical signals. Advancements in micro and nanofabrication technologies have led to the development of progressively smaller micro-electro-mechanical-system (MEMS) microphone assemblies. The fabrication process of some acoustic transducers included in microphone assemblies involves etching sacrificial layers disposed between a diaphragm and back plate of the acoustic transducer. A rough etch front of the etched sacrificial layer can result in locations of stress concentration on the diaphragm, and can result in damage to or failure of the diaphragm.

SUMMARY

In some embodiments, an acoustic transducer comprises a transducer substrate having an aperture defined therethrough. At least one diaphragm is disposed on the transducer substrate over the aperture. A back plate is disposed on the transducer substrate and axially spaced apart from the at least one diaphragm. A perimetral support structure is disposed circumferentially between the at least one diaphragm and the back plate at a radially outer perimeter of the back plate. A plurality of perimetral release holes are defined circumferentially through at least one of the at least one diaphragm or the back plate proximate to and radially inwards of the perimetral support structure, at least a portion of the plurality of perimetral release holes defining a non-circular shape.

In some embodiments, an acoustic transducer comprises a transducer substrate having an aperture defined therethrough. A diaphragm is disposed on the transducer substrate over the aperture. A back plate is disposed on the transducer substrate and axially spaced apart from the diaphragm. A perimetral support structure is disposed circumferentially between the diaphragm and the back plate at a radially outer perimeter of the back plate. A plurality of perimetral release holes are defined circumferentially through the back plate proximate to and radially inwards of the perimetral support structure, at least a portion of the plurality of perimetral release holes defining a non-circular shape.

In some embodiments, an acoustic transducer comprises a transducer substrate defining an aperture therethrough. A first diaphragm is disposed on the transducer substrate. A second diaphragm is disposed on the transducer and axially spaced apart from the first diaphragm such that a cavity is formed therebetween, the cavity having a pressure lower than atmospheric pressure. A back plate is disposed in the cavity between the first diaphragm and the second diaphragm. A perimetral support structure is disposed circumferentially between the first diaphragm and the second diaphragm at a radially outer perimeter of the first diaphragm and the second diaphragm. A plurality of perimetral release holes are defined circumferentially through at least one of the second diaphragm and the back plate located proximate to and radially inwards of the perimetral support structure, at least a portion of the plurality of perimetral release holes defining a non-circular shape.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1:
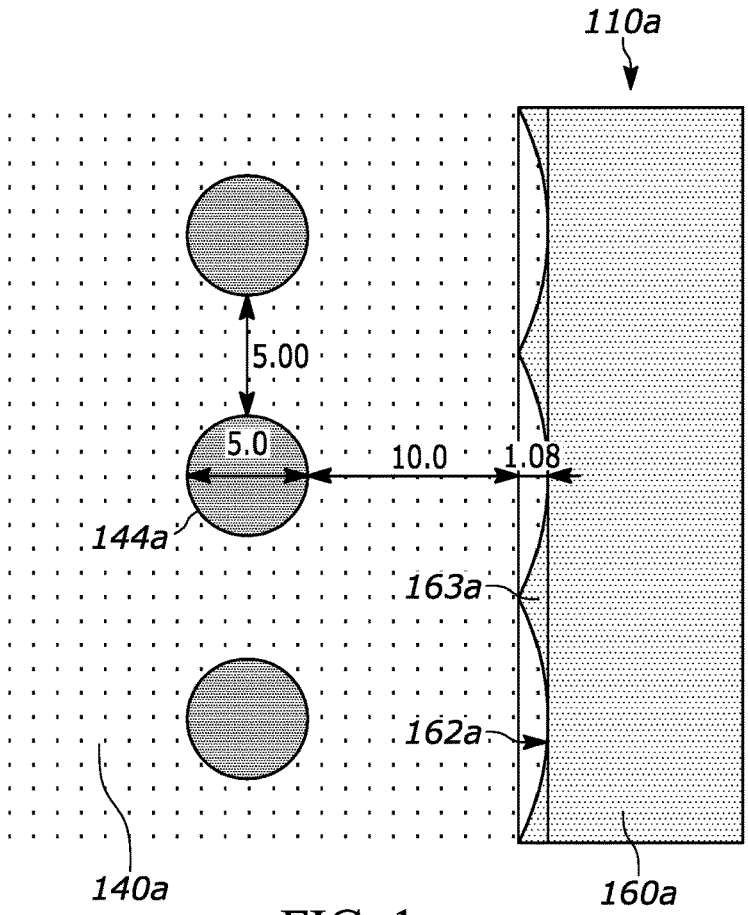
FIG. 1 is a top plan view of a portion of a simulated acoustic transducer that includes circular perimetral release holes.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION

Embodiments described herein relate generally to acoustic transducers, and microphone assemblies including acoustic transducers that have a plurality of non-circular perimetral release holes defined proximate to a perimetral edge of a diaphragm and/or back plate of acoustic transducers where a perimetral support structure is located. The release holes are configured to provide a smooth etch front at the perimetral support structure.

Small MEMS microphone assemblies have allowed incorporation of such microphone assemblies in compact devices such as cell phones, laptops, wearables, TV/set-top box remotes, etc. Some microphone assemblies include acoustic transducers that have a diaphragm disposed on a transducer substrate. Other microphone assemblies include acoustic transducers that include a back plate disposed on a substrate and a diaphragm disposed on the back plate distal from the substrate. Still other microphone assemblies include an acoustic transducer that include a back plate disposed between two diaphragms in a cavity that is at a pressure lower than environmental pressure.

Any of the above described microphone assemblies may include a perimetral support structure disposed proximate to the perimetral edge of the diaphragm and the back plate. Such perimetral support structures may serve to provide structural support to the one or more diaphragms that are in contact with the perimetral support structure, and may also provide stress relief. The perimetral support structures are formed during the fabrication process by etching sacrificial layers disposed between the back plate and the diaphragm. To access the sacrificial layers disposed between the back plate and the diaphragm, a plurality of holes are defined through the back plate and/or the diaphragm to allow a liquid etchant to penetrate in between the back plate and the diaphragm and etch the sacrificial layers to form the perimetral support structure.

Furthermore, a plurality of perimetral release holes may be defined proximate to a perimeter of the diaphragm and/or the back plate to the allow etchant to penetrate between the diaphragm and the back plate and etch the remaining sacrificial layer to define an "etch front" of the perimetral support structure, i.e., define a surface of the perimetral support structure that forms a boundary of the volume between the diaphragm and the back plate. The etch front is generally scalloped and a length of the scallop protrusion is generally used to indicate smoothness of the etch front. A large length of the scallop protrusion (e.g., greater than 1 micron) can lead to sharp edges between adjacent scallops. These sharp edges create stress concentration points on the diaphragm disposed on the perimetral support structure, and can lead to failure of the diaphragm.

Some acoustic transducers include circular perimetral release holes to allow a liquid etchant to flow therethrough and etch the sacrificial release layer proximate to a periphery of the diaphragm and the back plate of the acoustic transducer, and form the perimetral support structure. However, such circular perimetral release holes have certain drawbacks. For example, FIG. 1 is a top plan view of a portion of a simulated acoustic transducer 110*a* that includes a plurality of circular perimetral release holes 144*a*. The perimetral release holes 144*a* are arranged in a circumferential array around a central axis of the acoustic transducer and located proximate to a peripheral edge of the back plate 140*a*. Etchant penetrates through the perimetral release holes 144*a* and etches the sacrificial material disposed beneath the back plate 140*a* to define a perimetral support structure 160*a*. An etch front 162*a* of the perimetral support structure 160*a* has a plurality of scallops 163*a* formed due to overlapping waves of etchant that penetrate through each of the adjacent perimetral release holes 144*a*.

In this example, the etch was timed such that a radial distance from an edge of each perimetral release hole 144*a* to a tip of corresponding scallop 163*a* is about 10 microns. An edge to edge distance between each adjacent perimetral release hole 144*a* is about 5 microns and a diameter of each of the circular perimetral release hole 144*a* is 5 microns. This configuration yields scallops 163*a* having an axial length from a base to a tip of each scallop 163*a*, which serves a measure of smoothness of the etch front 162*a*, of greater than 1 micron. Such a scallop height may create substantial stress concentration zones at locations where a diaphragm (not shown), that may be disposed beneath the back plate 140*a*, contacts the perimetral support structure 160*a*. These stress concentration zones can lead to failure of the diaphragm, for example, when the diaphragm is subjected to high static loads or high pressure events (e.g., acoustic pressures up to or greater than about 700 kPa).

One method of achieving smoother etch fronts is to increase a time period for which the etching is performed. However, this increases the radial distance from the edge of the perimetral release holes to the etch front that may be undesirable due to die size preferences of the acoustic transducer, inefficient use of space, and/or resulting squeeze damping in the unperforated perimetral region between the diaphragm and one or both of the back plate or the transducer substrate on which the diaphragm is disposed.

Figure 2:
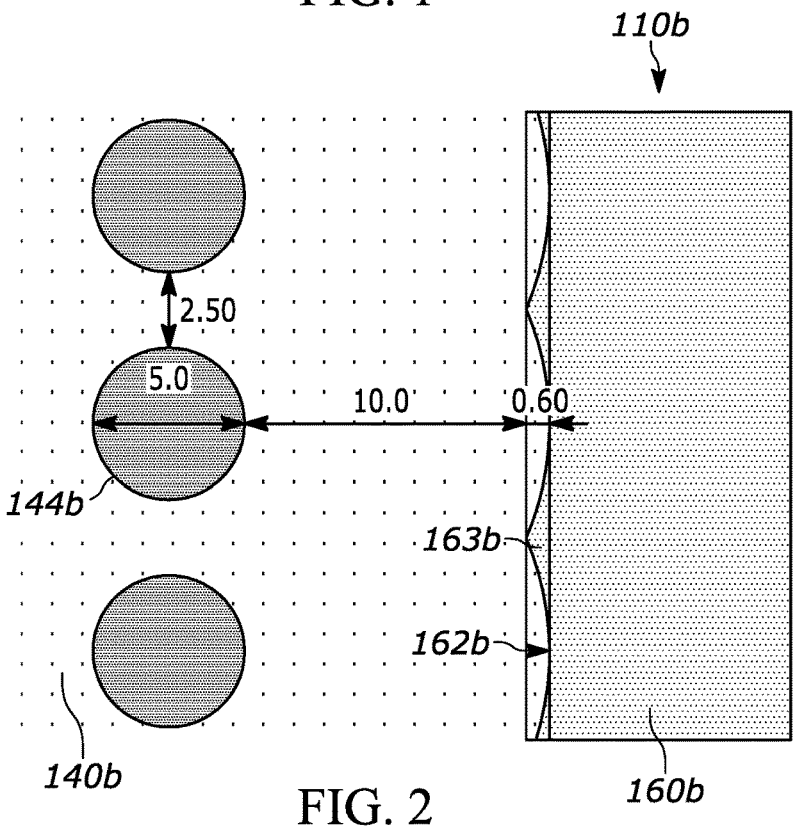
FIG. 2 is a top plan view of portion of another simulated acoustic transducer that includes circular perimetral release holes.

Another method of achieving a smoother etch front is to decrease the edge-to-edge distance between adjacent perimetral release holes. For example, FIG. 2 is a top plan view of a portion of another simulated acoustic transducer 110*b* that includes circular perimetral release holes 144*b* defined through a back plate 140*b* of the acoustic transducer 110*b*. Each of the plurality of perimetral release holes 144*b* has a diameter of about 5 microns, but an edge-to-edge distance between adjacent perimetral release holes 144*b* is reduced to about 2.5 microns. An etch front 162*b* of a corresponding perimetral support structure 160*b* is located at a distance of 10 microns, but due to the smaller edge to edge distance between the perimetral release holes 144*b*, the etch front 162*b* has a plurality of scallops 163*b*, each having a length of about 0.6 microns which is substantially less than the lengths of the scallops 163*a*. However, reduction in edge-to-edge distance of the perimetral release holes is often not achievable due to fabrication limitations (e.g., fabrication limits of optical lithography equipment).

In contrast, embodiments of the acoustic transducers described herein that include non-circular perimetral release holes may provide one or more benefits including, for example: (1) providing a smoother etch front without having to increase fabrication time or complexity; (2) allowing easy integration in existing fabrication processes; and (3) reducing stress concentration, thereby reducing acoustic transducer failure rates even when operating at pressures up to or greater than about 700 kPa.

Figure 3:
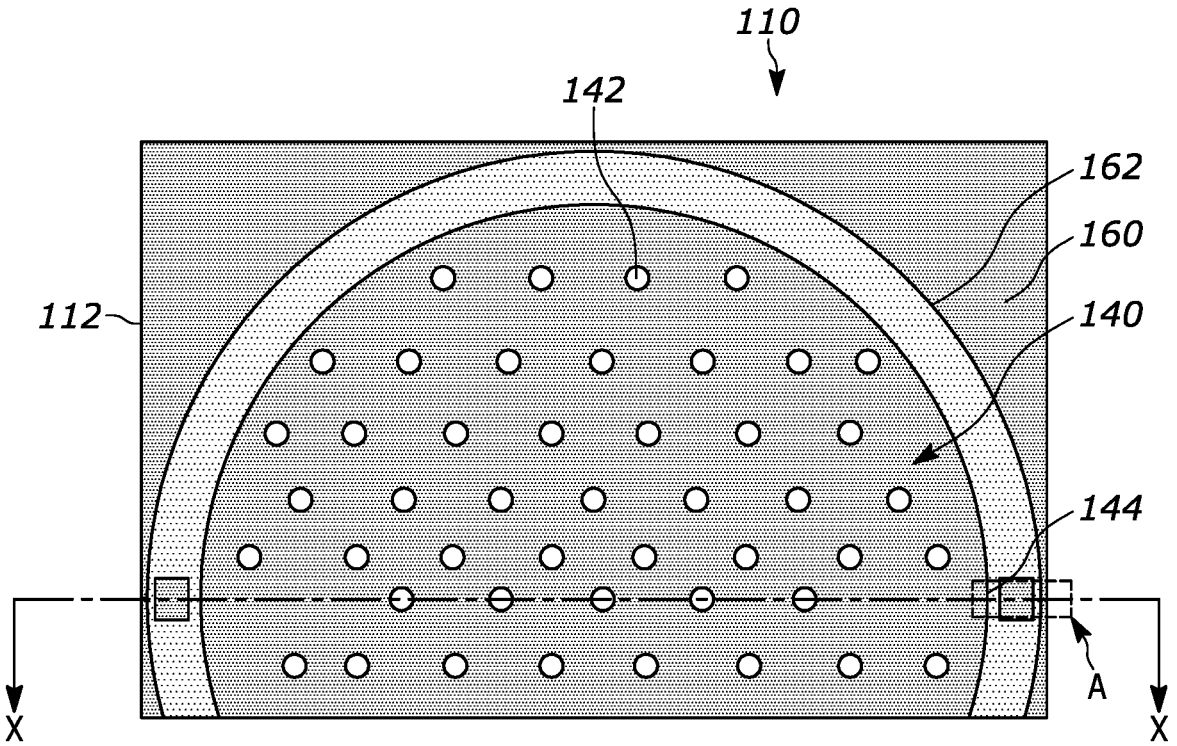
FIG. 3 is a top plan view of a portion of an acoustic transducer including a plurality of non-circular perimetral release holes, according to an embodiment.
Figure 4:
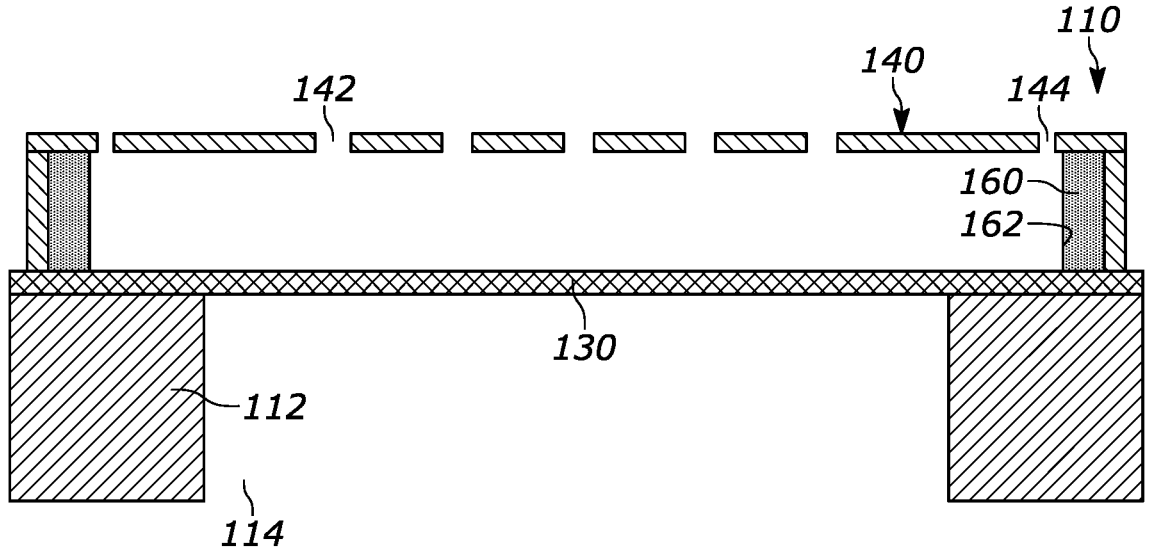
FIG. 4 is a side cross-section view of the acoustic transducer of FIG. 3 taken along the line X-X in FIG. 3.

Referring now to FIGS. 3-4 an acoustic transducer 110 is shown, according to an embodiment. As shown in FIG. 4, the acoustic transducer 110 includes a transducer substrate 112 having a diaphragm 130 disposed thereon. In some embodiments, the transducer substrate 112 may be formed from silicon, glass, ceramics, or any other suitable material. The transducer substrate 112 defines an aperture 114 therethrough. The diaphragm 130 is disposed on transducer substrate 112 over the aperture 114. The diaphragm 130 may be formed from any suitable material, for example, silicon, polysilicon, silicon nitride, a combination thereof, or any other suitable material. In particular embodiments, the diaphragm 130 may include a multilayered or composite having a plurality of layers (e.g., an insulative layer and a conductive layer). While not shown, in some embodiments, a pierce may also be defined through the diaphragm 130.

A back plate 140 is disposed on the transducer substrate 112 over the aperture 114 and axially spaced apart from the diaphragm 130. The back plate 140 may be formed from polysilicon, silicon nitride, or any other suitable materials (e.g., silicon oxide, silicon, ceramics, etc.), or layers (e.g., interposed layers) thereof. A plurality of back plate openings 142 are defined through the back plate 140 so as to allow the air to be in fluid communication with the diaphragm 130 through the back plate 140, and may also allow an etchant (e.g., a liquid etchant) to penetrate below the back plate 140 to etch a sacrificial layer that is disposed between the back plate 140 and the diaphragm 130 during fabrication of the acoustic transducer 110.

A perimetral support structure 160 is disposed circumferentially between the diaphragm 130 and the back plate 140 at a radially outer perimeter of the back plate 140. The perimetral support structure 160 may be fabricated by etching the sacrificial layer, as previously described herein. The back plate 140 further includes a plurality of perimetral release holes 144 defined circumferentially through the back plate 140 proximate to and radially inwards of the perimetral support structure 160. Each of the plurality of perimetral release holes 144 define a non-circular shape, such that the etchant penetrating through the perimetral release holes 144 form a smoother etch front 162 of the perimetral support structure 160 relative to an acoustic transducer that has the same configuration as the acoustic transducer 110, but includes circular perimetral release holes.

Figure 5:
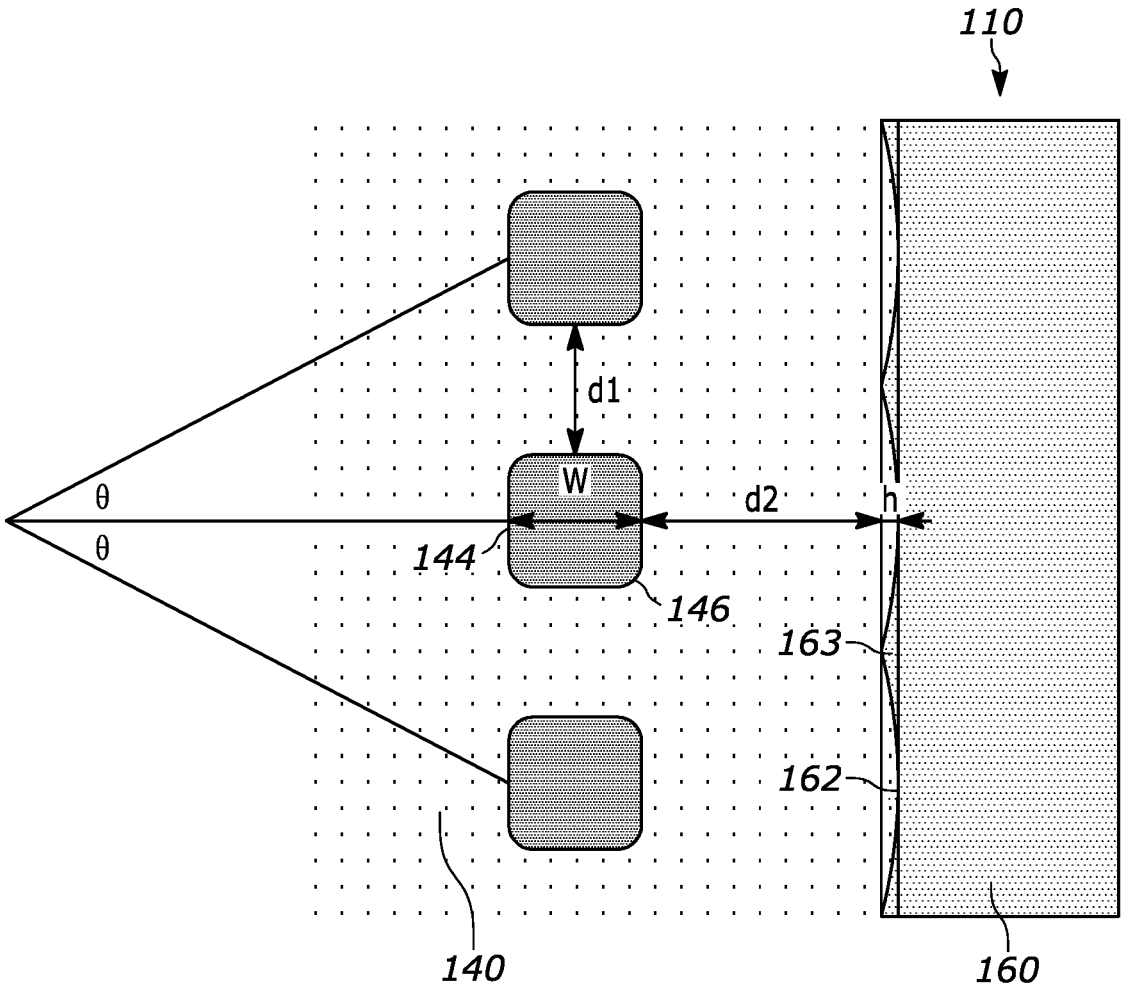
FIG. 5 is a top plan view of a portion of the acoustic transducer of FIG. 3 indicated by the arrow A in FIG. 3 showing the non-circular perimetral release holes that have a square shape with filleted corners.

The non-circular perimetral release holes 144 may have any suitable shape. For example, FIG. 5 shows a portion of the acoustic transducer 110 indicated by the arrow A in FIG. 3. In this example, the perimetral release holes 144 have a square shape having filleted corners 146. The filleted corners 146 may reduce stress concentration at the corners, which can lead to failure of the back plate 140. In some embodiments, an edge-to-edge distance d1 between adjacent perimetral release holes 144 is about 5 microns, and a width of the perimetral release holes is about 5 microns. Furthermore, a radial angle θ between adjacent perimetral release holes 144 may be equal to each other. In other words, the perimetral release holes 144 may be arranged in an equally spaced circumferential array about a central axis of the acoustic transducer 110 such that the perimetral release holes 144 are spaced apart by an equal radial distance.

A radial distance d2 from an edge of a perimetral release hole 144 to a tip of a corresponding scallop 163 is about 10 microns, and a height h of each of a plurality of scallops 163 of the etch front 162 of the perimetral support structure 160 is about 0.6 microns. This is almost 0.5× of the height of the scallops 163*a* (FIG. 1) of the perimetral support structure 160*a* of the acoustic transducer 110*a* that includes circular perimetral release holes 144*a* arranged in the same configuration as the non-circular perimetral release holes 144. Therefore, without reducing the spacing between the perimetral release holes 144 or increasing etch time, a smoother etch front 162 is achieved with the non-circular perimetral release holes 144.

A fillet radius of the corners 146 of the perimetral release holes 144 can be in a range of 0.25 microns to half of a width of the square perimetral release holes 144. In some embodiments, the fillet radius of the corners 146 can be about 0.5 micron. In other embodiments, the fillet radius of the corners 146 can be about 1 micron. In particular embodiments, the perimetral release holes 144 have dimensions of about 8 microns×about 8 microns, inclusive, a fillet radius of about 2 microns, inclusive, and an edge-to-edge spacing about 10 microns to about 14 microns, inclusive.

Figure 6:
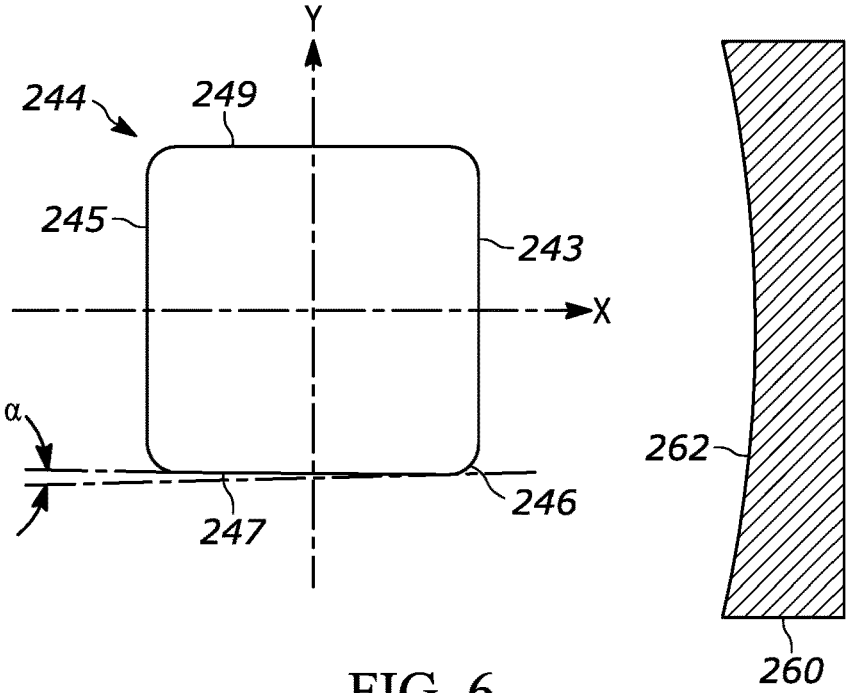
FIG. 6 is a top plan view of a non-circular perimetral release hole that has a trapezoidal shape with filleted corners, according to another embodiment.

In some embodiments, a non-circular perimetral release hole can have a trapezoidal shape. For example, FIG. 6 is a top plan view of a perimetral release hole 244 relative to an etch front 262 of a corresponding perimetral support structure 260. The perimetral release hole 244 has a trapezoidal shape that has a first side 243 that is located closer to a peripheral edge of the back plate or diaphragm in which the perimetral release hole 244 is formed is longer relative to a second side 245 that is located opposite thereof. Corners 246 of the perimetral release hole 244 are filleted and may have a fillet radius in a range of 0.25 microns to half of a width of the perimetral release hole 244. Third and fourth sides 247 and 249 extend from the longer first side 243 to shorter second side 245 such that each of the third and fourth sides 247 and 249 are inclined at an inclination angle α from the first side 243 to the second side 245. In some embodiments, the inclination angle α may be in a range of about 1 degree to about 5 degrees.

Figure 7:
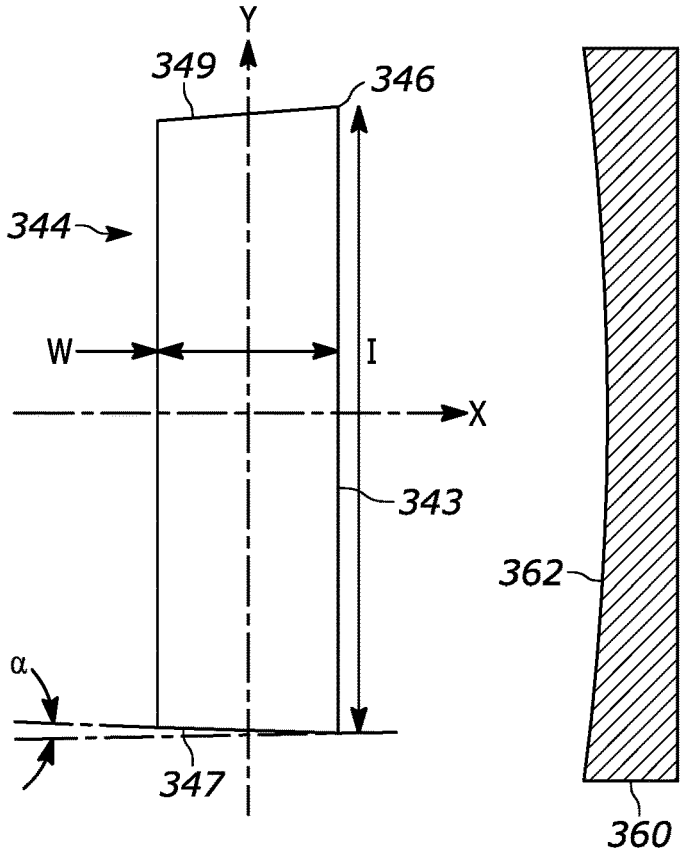
FIG. 7 is a top plan view of a non-circular perimetral release hole that has a trapezoidal shape, according to still another embodiment.

In some embodiments, a length of a perimetral release hole having a trapezoidal shape may be different from its width. For example, FIG. 7 shows a top plan view of a trapezoid shaped perimetral release hole 344 relative to an etch front 362 of a corresponding perimetral support structure 360. A longer first side 343 of the perimetral release hole 344 that is proximate to the etch front 362 has a length l that is longer than its width w, according to another embodiment. The perimetral release hole 344 has sharp corners 346. Sharp corners may further reduce the protrusion length of the scallops in the perimetral support structure compared to otherwise equivalent embodiments with rounded corners, which tends to make the diaphragm less likely to fracture at the point at which it is supported by the perimetral support structure. However, in other embodiments, the corners 346 may be rounded, for example, to reduce stress concentration as previously described herein, which makes the structure more robust and resistant to fracturing at the release hole location In some embodiments, a ratio of a length to a width of trapezoid shaped perimetral release hole 344 may be in a range of 0.5:1 to 20:1, inclusive. Sides 347 and 349 of the perimetral release hole 344 are inclined inwards at an inclination angle α in a range of about 1 degrees to about 5 degrees from the first side 343 as shown in FIG. 7.

Figure 8:
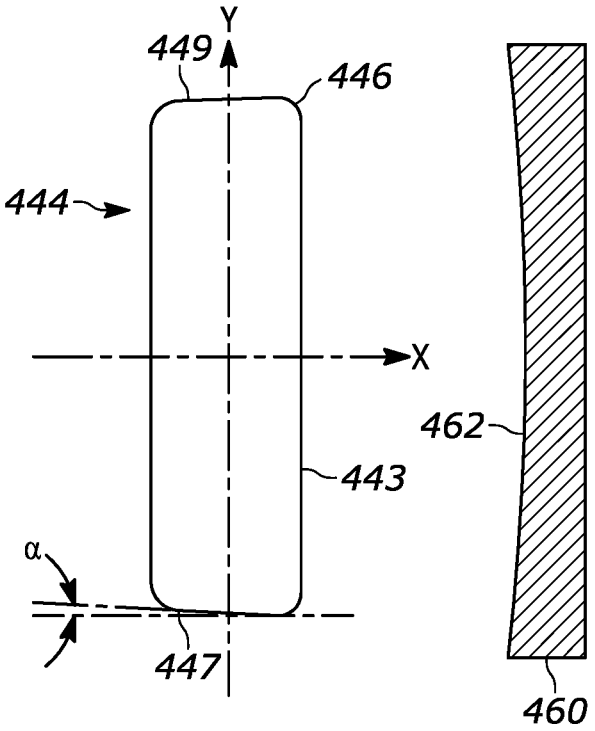
FIG. 8 is a top plan view of a non-circular perimetral release hole that has a trapezoidal shape with filleted corners, according to yet another embodiment.

FIG. 8 is a top plan view of another embodiment of a perimetral release hole 444 relative to an etch front 462 of a corresponding perimetral support structure 460. The perimetral release hole 444 is similar to the perimetral release hole 344, with the difference being that the hole 444 has filleted corners 446 (e.g., to reduce stress concentration). In some embodiments, a ratio of a length to a width of trapezoid shaped perimetral release hole 444 may be in a range of 0.5:1 to 20:1, inclusive. Furthermore, sides 447 and 449 of the perimetral release hole 444 are inclined inwards at an inclination angle α in a range of about 1 degrees to about 5 degrees from the first side 443 as shown in FIG. 8.

Figure 9:
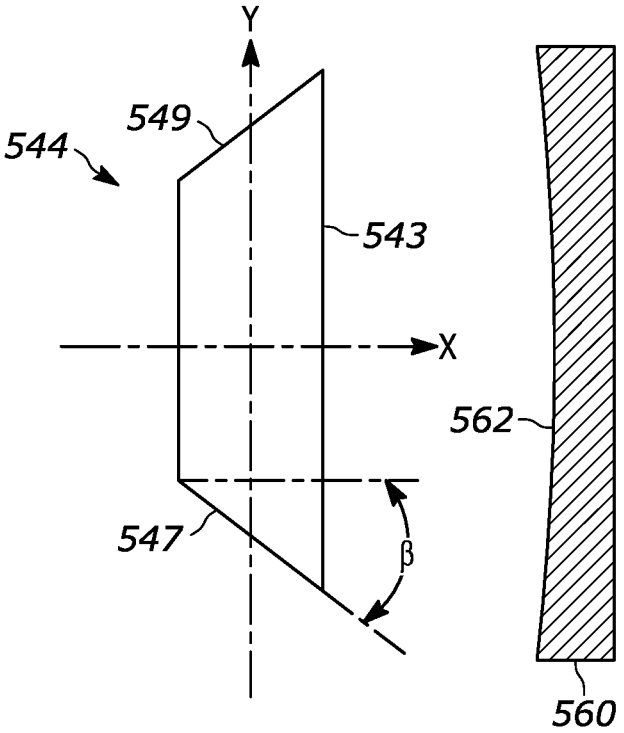
FIG. 9 is a top plan view of a non-circular perimetral release hole that has a trapezoidal shape, according to still another embodiment.

FIG. 9 is a top plan view of a non-circular perimetral release hole 544 that has a trapezoidal shape relative to an etch front 562 of a corresponding perimetral support structure 560, according to still another embodiment. The perimetral release hole 544 is similar to the perimetral release hole 344, with the difference that an inclination angle β of sides 547 and 549 is in a range of 25 degrees to 60 degrees.

Figure 10:
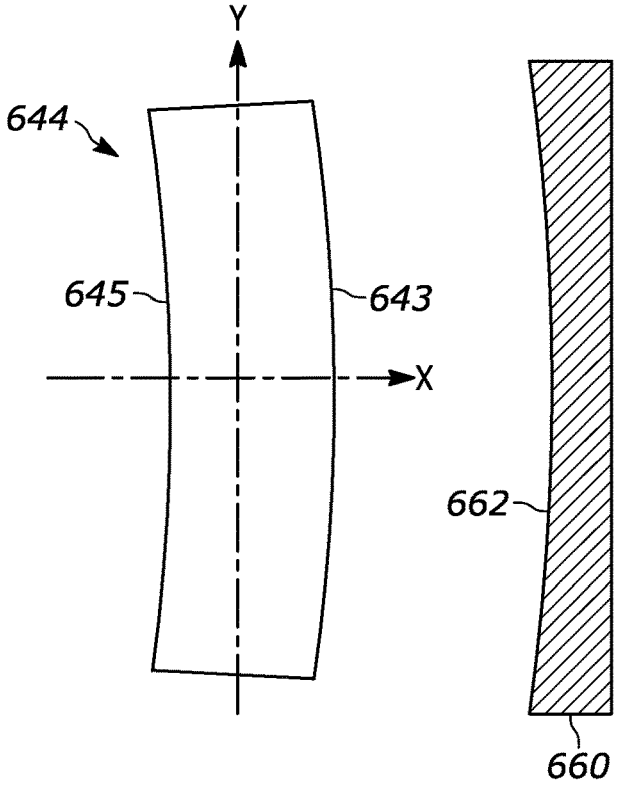
FIG. 10 is a top plan view of a non-circular perimetral release hole that has a toroidal arc segment shape, according to yet another embodiment.

FIG. 10 is a top plan view of a non-circular perimetral release hole 644 relative to an etch front 662 of a corresponding perimetral support structure 660. The perimetral release hole 644 has a toroidal arc segment shape, according to yet another embodiment. This results in longer sides 643 and 645 of the perimetral release hole 644 being curved. In various embodiments, a radius of curvature of the sides 643 and 645 may be in a range of 0.1 mm to 1 mm.

Figure 11:
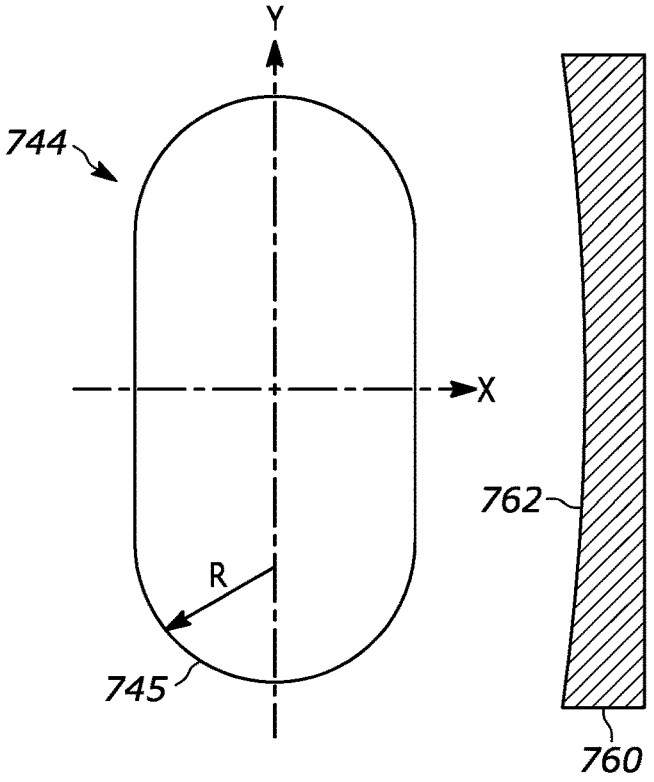
FIG. 11 is a top plan view of a non-circular perimetral release hole that has an oblong shape, according to another embodiment.

FIG. 11 is a top plan view of a non-circular perimetral release hole 744 that has an oblong shape shown relative to an etch front 762 of a corresponding perimetral support structure 760, according to another embodiment. The perimetral release hole 744 includes rounded ends 745 that may have a radius R that is about half of a width of the perimetral release hole 744. In various embodiments, a width of the perimetral release hole 744 may be in a range of 0.5 micron to 10 microns. In some embodiments, the oblong shaped perimetral release holes have dimensions of about 6 microns×about 14 microns with edge-to-edge spacing in a range of 9 microns to 11 micron, inclusive.

It should be appreciated that in various embodiments, the acoustic transducer 110 or any other acoustic transducer described herein may include perimetral release holes defined through the back plate and/or diaphragm thereof, which have the same non-circular shape. In other embodiments, different shaped (e.g., different non-circular shaped or a combination of circular and non-circular shaped) perimetral release holes may be defined through the back plate and/or diaphragm of an acoustic transducer. Furthermore, the perimetral release holes may be arranged in an equally spaced array, unequally spaced array, staggered, or in any other suitable configuration.

Figure 12:
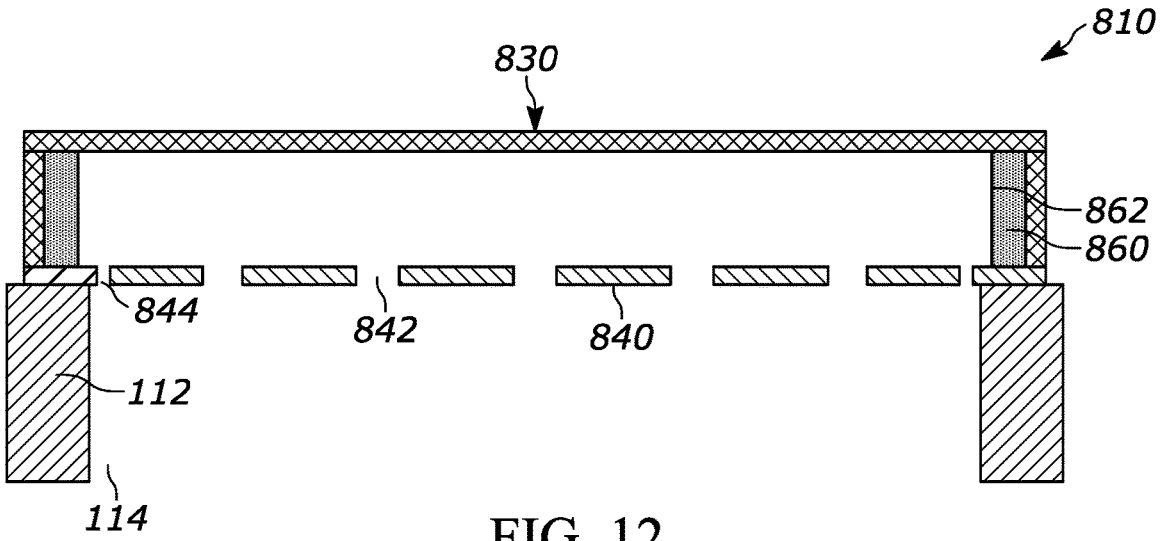
FIG. 12 is a side cross-section view of an acoustic transducer, according to an embodiment.

FIG. 12 is a side cross-section view of an acoustic transducer 810, according to an embodiment. The acoustic transducer 810 includes the transducer substrate 112 defining the aperture 114. A back plate 840 is disposed on the transducer substrate 112 over the aperture 114. A diaphragm 830 is disposed on the transducer substrate 112 over the back plate 840 and axially spaced apart from the back plate 840. The diaphragm 830 may be formed from any suitable material, for example, silicon, polysilicon, silicon nitride, a combination thereof, or any other suitable material. In particular embodiments, the diaphragm 830 may include a multilayered or composite diaphragm having a plurality of layers (e.g., an insulative layer and a conductive layer). While not shown, in some embodiments, a pierce may also be defined through the diaphragm 830.

The back plate 840 may be formed from polysilicon, silicon nitride, or any other suitable materials (e.g., silicon oxide, silicon, ceramics, etc.), or layers (e.g., interposed layers) thereof. A plurality of back plate openings 842 are defined through the back plate 840, for example, to allow air to communicate through the back plate 840 to the diaphragm 830.

A perimetral support structure 860 is disposed circumferentially between the diaphragm 830 and the back plate 840 at a radially outer perimeter of the back plate 840. The perimetral support structure 860 may be fabricated by etching the sacrificial layer, as previously described herein. The back plate 840 further includes a plurality of perimetral release holes 844 defined circumferentially through the back plate 840 proximate to and radially inwards of the perimetral support structure 860. Each of the plurality of perimetral release holes 844 define a non-circular shape, such that the etchant penetrating through the perimetral release holes 844 forms a smoother etch front 862 of the perimetral support structure 860, as previously described herein. The non-circular perimetral release holes 844 may have a square, trapezoidal, toroidal arc segment, oblong, or any other suitable shape described herein.

Figure 13:
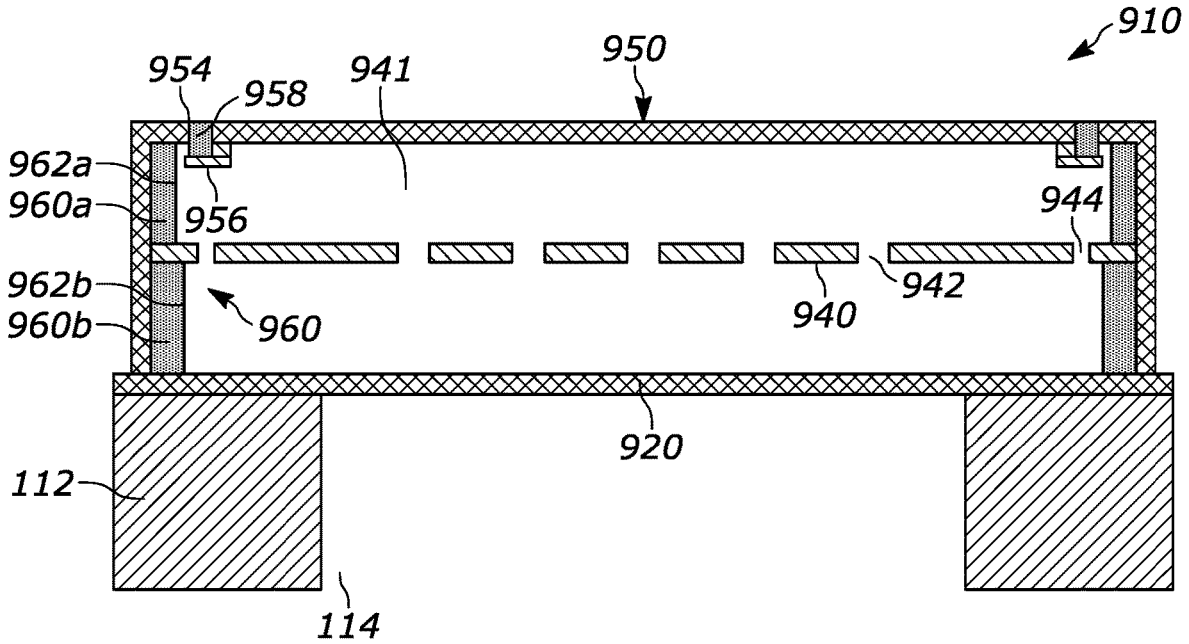
FIG. 13 is a side cross-section view of an acoustic transducer, according to another embodiment.

FIG. 13 is a side cross-section view of an acoustic transducer 910, according to another embodiment. The acoustic transducer 910 includes the transducer substrate 112 defining the aperture 114. A first or bottom diaphragm 920 is disposed on the transducer substrate 112 over the aperture 114. A second or top diaphragm 950 is disposed on the transducer substrate 112 and axially spaced apart from the first diaphragm 920 such that a cavity 941 is formed therebetween. The cavity 941 has a pressure lower than atmospheric pressure (e.g., in a range of 10 Torr to less than 1 mTorr, or in a range of 0.1 mTorr to less than 1 Torr).

A back plate 940 is disposed in the cavity 941 between the first diaphragm 920 and the second diaphragm 950. A plurality of back plate openings 942 are defined through the back plate 940. A perimetral support structure 960 is disposed in the cavity 941 between the first diaphragm 920 and the second diaphragm 950. The peripheral edges of the back plate 940 may be embedded in the perimetral support structure 960, such that the perimetral support structure 960 includes a perimetral support structure first portion **960*a* disposed between the second diaphragm 950 and the back plate 940, and a perimetral support structure second portion 960*b* disposed between the back plate 940 and the first diaphragm 920**.

A plurality of non-circular second diaphragm perimetral release holes 954 are formed in the second diaphragm 950, and a plurality of non-circular back plate perimetral release holes 944 are formed in the back plate 940. During fabrication, liquid etchant enters the portion of the cavity 941 between the second diaphragm 950 and the back plate 940 via the non-circular second diaphragm perimetral release holes 954 to form a smooth etch front **962*a* of the perimetral support structure first portion 960*a*. Furthermore, liquid etchant enters the portion of the cavity 941 between the back plate 940 and the first diaphragm 920 via the non-circular back plate perimetral release holes 944 to provide a smooth etch front 962*b* of the perimetral support structure second portion 960*b***.

The second diaphragm perimetral release holes 954 may be sealed via a sealing material 958 (e.g., polysilicon, silicon nitride, etc.). A catch or ledge 956 may be disposed beneath each of the second diaphragm perimetral release holes 954 to provide a base for depositing the sealing material 958 thereon, until the sealing material 958 fills the gap between the second diaphragm 950 and the catch or ledge 956 beneath the perimetral release hole 954. The non-circular perimetral release holes 944, 954 may have a square, trapezoidal, toroidal arc segment, oblong, or any other suitable shape described herein.

Figure 14:
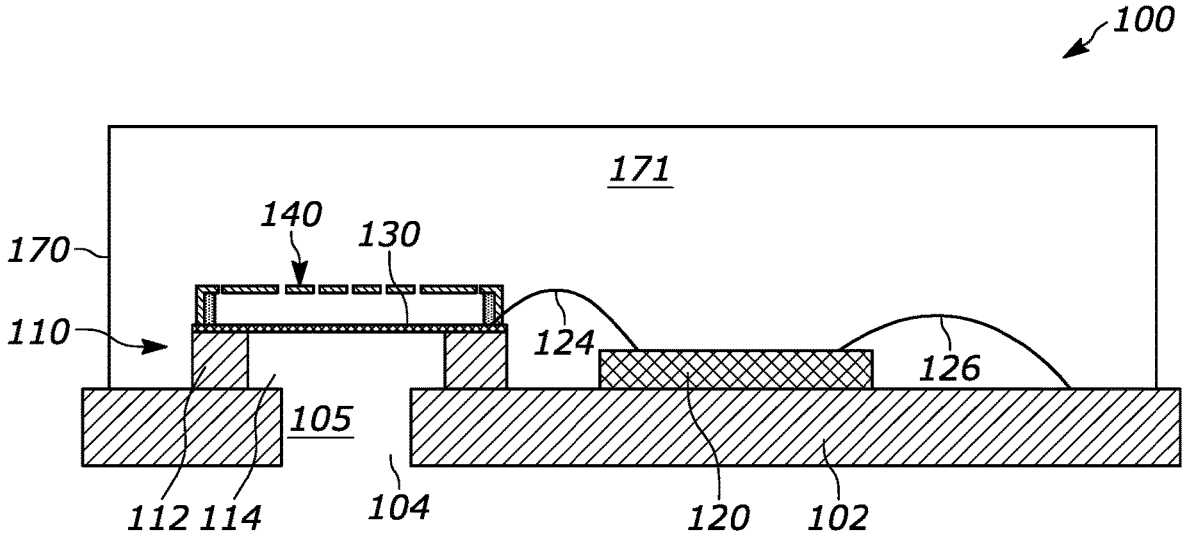
FIG. 14 is a side cross-section view of a microphone assembly including the acoustic transducer of FIGS. 3-4, according to an embodiment.

Any of the acoustic transducers described herein may be included in a microphone assembly. Referring now to FIG. 14, a microphone assembly 100 is shown, according to an embodiment. The microphone assembly 100 may be used for converting acoustic signals into electrical signals in any device such as, for example, cell phones, laptops, TV/set top box remotes, tablets, audio systems, head phones, wearables, portable speakers, car sound systems or any other device which uses a microphone assembly.

The microphone assembly 100 includes a base 102, the acoustic transducer 110 disposed on the base 102, an integrated circuit 120, and an enclosure or cover 170. The base 102 can be formed from materials used in printed circuit board (PCB) fabrication (e.g., plastics). For example, the base 102 may include a PCB configured to mount the acoustic transducer 110, the integrated circuit 120, and the enclosure 170 thereon. A sound port 104 is formed through the base 102. The acoustic transducer 110, is positioned on the sound port 104, and is configured to generate an electrical signal responsive to an acoustic signal received through the sound port 104. While shown as including the acoustic transducer 110, in other embodiments, the microphone assembly 100 may include the acoustic transducer 810, 910 or any other acoustic transducer described herein.

In FIG. 14, the acoustic transducer 110 and the integrated circuit 120 are shown disposed on a surface of the base 102, but in other embodiments one or more of these components may be disposed on the enclosure 170 (e.g., on an inner surface of the enclosure 170) or sidewalls of the enclosure 170 or stacked atop one another. In some embodiments, the base 102 includes an external-device interface having a plurality of contacts coupled to the integrated circuit 120, for example, to connection pads (e.g., bonding pads) which may be provided on the integrated circuit 120. The contacts may be embodied as pins, pads, bumps or balls among other known or future mounting structures. The functions and number of contacts on the external-device interface depend on the protocol or protocols implemented and may include power, ground, data, and clock contacts among others. The external-device interface permits integration of the microphone assembly 100 with a host device using reflow-soldering, fusion bonding, or other assembly processes.

As shown in FIG. 14, the diaphragm 130 of the acoustic transducer 110 separates a front volume 105 defined between the diaphragm 130 and the sound port 104, from a back volume 171 of the microphone assembly 100 between the enclosure 170 and diaphragm 130. The embodiment shown in FIG. 14 includes a bottom port microphone assembly 100 in which the sound port 104 is defined in the base 102 such that the internal volume 171 of the enclosure 170 defines the back volume 171. It should be appreciated that in other embodiments, the concepts described herein may be implemented in a top port microphone assembly in which a sound port is defined in the enclosure 170 of the microphone assembly 100. In some embodiments, a vent may be defined in the enclosure 170 to allow pressure equalization. In other embodiments, pressure equalization may be provided via a pierce through the diaphragm 130.

The integrated circuit 120 is positioned on the base 102. The integrated circuit 120 is electrically coupled to the acoustic transducer 110, for example, via a first electrical lead 124, and to the base 102 (e.g., to a trace or other electrical contact disposed on the base 102) via a second electrical lead 126. The integrated circuit 120 receives an electrical signal from the acoustic transducer 110 and may amplify and condition the signal before outputting a digital or analog electrical signal as is known generally. The integrated circuit 120 may also include a protocol interface (not shown), depending on the output protocol desired. The integrated circuit 120 may also be configured to permit programming or interrogation thereof as described herein. Exemplary protocols include but are not limited to PDM, PCM, SoundWire, I2C, I2S and SPI, among others.

The integrated circuit 120 may include one or more components, for example, a processor, a memory, and/or a communication interface. The processor may be implemented as one or more general-purpose processors, an application specific integrated circuit (ASIC), one or more field programmable gate arrays (FPGAs), a digital signal processor (DSP), a group of processing components, or other suitable electronic processing components. In other embodiments, the DSP may be separate from the integrated circuit 120 and in some implementations, may be stacked on the integrated circuit 120. In some embodiments, the one or more processors may be shared by multiple circuits and, may execute instructions stored, or otherwise accessed, via different areas of memory). Alternatively or additionally, the one or more processors may be structured to perform or otherwise execute certain operations independent of one or more co-processors. In other example embodiments, two or more processors may be coupled via a bus to enable independent, parallel, pipelined, or multi-threaded instruction execution. All such variations are intended to fall within the scope of the present disclosure. For example, a circuit as described herein may include one or more transistors, logic gates (e.g., NAND, AND, NOR, OR, XOR, NOT, XNOR, etc.), resistors, multiplexers, registers, capacitors, inductors, diodes, wiring, and so on.

The enclosure 170 is positioned on the base 102. The enclosure 170 defines the internal volume 171 within which at least the integrated circuit 120 and the acoustic transducer 110 is positioned. For example, as shown in FIG. 14, the enclosure 170 is positioned on the base 102 such that the base 102 forms a base of the microphone assembly 100, and the base 102 and the enclosure 170 cooperatively define the internal volume 171. As previously described herein, the internal volume 171 defines the back volume of the microphone assembly 100.

The enclosure 170 may be formed from one or more suitable materials such as, for example, metals (e.g., aluminum, copper, stainless steel, gold, nickel, etc.), and may be coupled to the base 102, for example, via an adhesive, soldered or fusion bonded thereto. In particular embodiments, the enclosure 170 may be a metal/plastic composite, for example, including metal with an insert molded or over molded plastic layer.

In some embodiments, an acoustic transducer comprises a transducer substrate having an aperture defined therethrough; at least one diaphragm disposed on the transducer substrate over the aperture; a back plate disposed on the transducer substrate and axially spaced apart from the at least one diaphragm; and a perimetral support structure disposed circumferentially between the at least one diaphragm and the back plate at a radially outer perimeter of the back plate, wherein a plurality of perimetral release holes are defined circumferentially through at least one of the at least one diaphragm or the back plate proximate to and radially inwards of the perimetral support structure, at least a portion of the plurality of perimetral release holes defining a non-circular shape.

In some embodiments, the non-circular shape is a square having filleted corners. In some embodiments, the non-circular shape is a trapezoid. In some embodiments, the corners of the trapezoid are filleted. In some embodiments, the trapezoid has a length that is longer than a width of thereof. In some embodiments, the non-circular shape is a toroidal arc segment. In some embodiments, the non-circular shape is oblong. In some embodiments, the non-circular shape has dimensions of about 6 microns×about 14 microns, and an edge-to-edge spacing between adjacent perimetral release holes of about 9 microns to about 11 microns, inclusive. In some embodiments, each of the plurality of perimetral release holes are separated by an equal radial distance.

In some embodiments, a microphone assembly comprises a base; an enclosure disposed on the base; the acoustic transducer of claim 1 disposed on the base within the enclosure, the acoustic transducer configured to generate an electrical signal responsive to acoustic activity. The acoustic transducer comprises a transducer substrate having an aperture defined therethrough; at least one diaphragm disposed on the transducer substrate over the aperture; a back plate disposed on the transducer substrate and axially spaced apart from the at least one diaphragm; and a perimetral support structure disposed circumferentially between the at least one diaphragm and the back plate at a radially outer perimeter of the back plate, wherein a plurality of perimetral release holes are defined circumferentially through at least one of the at least one diaphragm or the back plate proximate to and radially inwards of the perimetral support structure, at least a portion of the plurality of perimetral release holes defining a non-circular shape.

In some embodiments, an acoustic transducer comprises a transducer substrate having an aperture defined therethrough; a diaphragm disposed on the transducer substrate over the aperture; a back plate disposed on the transducer substrate and axially spaced apart from the diaphragm; and a perimetral support structure disposed circumferentially between the diaphragm and the back plate at a radially outer perimeter of the back plate, wherein a plurality of perimetral release holes are defined circumferentially through the back plate proximate to and radially inwards of the perimetral support structure, at least a portion of the plurality of perimetral release holes defining a non-circular shape.

In some embodiments, the diaphragm is located proximate to the transducer substrate, and the back plate is located over the diaphragm distal from the transducer substrate. In some embodiments, the back plate is located proximate to the transducer substrate, and the diaphragm is located over the back plate distal from the transducer substrate. In some embodiments, the non-circular shape is a square having filleted corners. In some embodiments, the non-circular shape is a trapezoid. In some embodiments, the non-circular shape is a toroidal arc segment. In some embodiments, the non-circular shape is oblong.

In some embodiments, an acoustic transducer comprises a transducer substrate defining an aperture therethrough; a first diaphragm disposed on the transducer substrate; a second diaphragm disposed on the transducer and axially spaced apart from the first diaphragm such that a cavity is formed therebetween; a back plate disposed in the cavity between the first diaphragm and the second diaphragm; and a perimetral support structure disposed circumferentially between the first diaphragm and the second diaphragm at a radially outer perimeter of the first diaphragm and the second diaphragm, wherein a plurality of perimetral release holes are defined circumferentially through at least one of the second diaphragm and the back plate located proximate to and radially inwards of the perimetral support structure, at least a portion of the plurality of perimetral release holes defining a non-circular shape.

In some embodiments, the non-circular shape is a square having filleted corners. In some embodiments, the non-circular shape is a trapezoid. In some embodiments, the non-circular shape is a toroidal arc segment. In some embodiments, the non-circular shape is oblong. In some embodiments, the non-circular shape has a dimensions of about 8 microns×about 8 microns, a filter radius of the filleted corners of about 2 microns, and an edge-to-edge spacing between adjacent perimetral release holes in a range of about 10 microns to 14 microns, inclusive. In some embodiments, the cavity has a pressure lower than atmospheric pressure.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. An acoustic transducer, comprising:

a transducer substrate having an aperture defined therethrough;

at least one diaphragm disposed on the transducer substrate over the aperture;

a back plate disposed on the transducer substrate and axially spaced apart from the at least one diaphragm; and a perimetral support structure disposed circumferentially between the at least one diaphragm and the back plate at a radially outer perimeter of the back plate, wherein a plurality of perimetral release holes are defined circumferentially through at least one of the at least one diaphragm or the back plate proximate to and radially inwards of the perimetral support structure, at least a portion of the plurality of perimetral release holes defining a non-circular shape.

2. The acoustic transducer of claim 1, wherein the non-circular shape is a square having filleted corners.

3. The acoustic transducer of claim 1, wherein the non-circular shape is a trapezoid.

4. The acoustic transducer of claim 3, wherein the corners of the trapezoid are filleted.

5. The acoustic transducer of claim 3, wherein the trapezoid has a length that is longer than a width of thereof, where the width is parallel to a direction radially outwards from a center of the perimetral support structure.

6. The acoustic transducer of claim 1, wherein the non-circular shape is a toroidal arc segment.

7. The acoustic transducer of claim 1, wherein the non-circular shape is oblong with a length longer than a width, where the width is parallel to a direction radially outwards from a center of the perimetral support structure.

8. The acoustic transducer of claim 7, wherein the non-circular shape has dimensions of 6 microns×14 microns, and an edge-to-edge spacing between adjacent perimetral release holes of 9 microns to 11 microns, inclusive.

9. The acoustic transducer of claim 1, wherein each of the plurality of perimetral release holes are separated by an equal radial distance.

10. The acoustic transducer of claim 1, wherein a section of an outer edge of each of the portion of the perimetral release holes is flatter than an arc of a circle with a center of curvature located at a center of the release hole, where the section is proximal to the perimetral support structure.

11. The acoustic transducer of claim 1, wherein a curvature of a section of an outer edge of each of the portion of the perimetral release holes more closely conforms to an average curvature of the perimetral support structure than a curvature of a circular release hole, where the section is proximal to the perimetral support structure.

12. The acoustic transducer of claim 1, wherein a curvature of a section of a radially outer perimeter on a side of each of the plurality of release holes proximate to the perimetral support structure is between and including a curvature that is flat and a curvature of less than a circle with a center of curvature located at a center of the release hole.

13. The acoustic transducer of claim 1, wherein a section of an outer edge of each of the portion of the perimetral release holes spans less than 180 degrees, where the section is proximal to the perimetral support structure.

14. An acoustic transducer, comprising:

a transducer substrate having an aperture defined therethrough;

a diaphragm disposed on the transducer substrate over the aperture;

a back plate disposed on the transducer substrate and axially spaced apart from the diaphragm; and a perimetral support structure disposed circumferentially between the diaphragm and the back plate at a radially outer perimeter of the back plate, wherein a plurality of perimetral release holes are defined circumferentially through the back plate proximate to and radially inwards of the perimetral support structure, at least a portion of the plurality of perimetral release holes defining a non-circular shape.

15. The acoustic transducer of claim 14, wherein the diaphragm is located proximate to the transducer substrate, and the back plate is located over the diaphragm distal from the transducer substrate.

16. The acoustic transducer of claim 14, wherein the non-circular shape is at least one of a square having filleted corners, a trapezoid, a toroidal arc segment or an oblong.

17. The acoustic transducer of claim 14, wherein a section of an outer edge of each of the portion of the perimetral release holes is flatter than an arc of a circle with a center of curvature located at a center of the release hole, where the section is proximal to the perimetral support structure.

18. The acoustic transducer of claim 14, wherein a curvature of a section of a radially outer perimeter on a side of each of the plurality of release holes proximate to the perimetral support structure is between and including a curvature that is flat and a curvature of less than a circle with a center of curvature located at a center of the release hole.

19. The acoustic transducer of claim 14, wherein a section of an outer edge of each of the portion of the perimetral release holes spans less than 180 degrees, where the section is proximal to the perimetral support structure.

20. An acoustic transducer, comprising:

a transducer substrate defining an aperture therethrough;

a first diaphragm disposed on the transducer substrate;

a second diaphragm disposed on the transducer and axially spaced apart from the first diaphragm such that a cavity is formed therebetween;

a back plate disposed in the cavity between the first diaphragm and the second diaphragm; and a perimetral support structure disposed circumferentially between the back plate and at least one selected from the first diaphragm and the second diaphragm at a radially outer perimeter of the back plate, wherein a plurality of perimetral release holes are defined circumferentially through at least one of the second diaphragm and the back plate located proximate to and radially inwards of the perimetral support structure, at least a portion of the plurality of perimetral release holes defining a non-circular shape.

* * * * *